United States Patent [19]

Williams et al.

[11] 4,179,090

[45] Dec. 18, 1979

[54] SCAFFOLDING

[76] Inventors: Alfred S. Williams, 10 Gloucester Rd., Ealing, London, W5 4BJ; Raymond Foskett, 20 Grove Park Ter., Chiswick, London, W4, both of England

[21] Appl. No.: 800,739

[22] Filed: May 26, 1977

[51] Int. Cl.[2] ..... E04G 3/08; E04G 5/04

[52] U.S. Cl. ..... 248/235; 182/82; 182/113

[58] Field of Search ..... 182/82, 178, 179, 229, 182/230, 113; 248/236, 235, 240.2; 403/311

[56] References Cited

U.S. PATENT DOCUMENTS

| | | | |
|---|---|---|---|
| 71,960 | 12/1867 | Bliss | 248/240.2 |
| 920,169 | 5/1909 | Neuberth | 403/311 |
| 1,937,608 | 12/1933 | Tobin | 182/229 |
| 2,279,850 | 4/1942 | Vansickle | 248/235 |
| 2,573,086 | 10/1951 | Yoshimoto | 248/235 |
| 2,583,368 | 6/1947 | French | 403/49 |
| 2,641,429 | 6/1953 | Kozak | 248/235 |
| 2,833,503 | 5/1958 | Harshbarger | 248/235 |
| 2,988,181 | 6/1961 | Darrey | 182/82 |
| 3,850,264 | 11/1974 | Salinas | 182/179 |

FOREIGN PATENT DOCUMENTS

| | | | |
|---|---|---|---|
| 2143700 | 9/1971 | Fed. Rep. of Germany | 182/178 |

OTHER PUBLICATIONS

"Shoring Equipment," Mills Scaffold Co., Jun. 1969, p. 27.

*Primary Examiner*—Reinaldo P. Machado
*Attorney, Agent, or Firm*—Robert D. Yeager

[57] ABSTRACT

A scaffolding bracket comprising a horizontal member arranged to act as a support for scaffold boards and a vertical member arranged to lie adjacent a vertical surface, the bracket having a plate for securing the bracket to the vertical surface and coupling means pivotally mounted within the angle formed between the horizontal and vertical members and arranged to receive a scaffold support member. The extremity of the support member may be provided with a swivel shoe plate.

13 Claims, 9 Drawing Figures

SCAFFOLDING

BACKGROUND OF THE INVENTION

1. Field of the Invention

This invention relates to scaffolding brackets intended to be used in pairs or more to support scaffold boards or the like at any required height above the ground such that an operator may perform any desired operation on a vertical wall or other surface.

2. Summary of the Invention

An object of the invention is to provide a scaffolding bracket which is simple and economic to construct, which is robust and which is simple to erect.

According to the invention there is provided a scaffolding bracket comprising a horizontal member adapted to support scaffold boards or the like and a vertical member connected to the horizontal member and arranged to be located adjacent a vertical surface, the bracket having means mounted thereon for securing the bracket to the vertical surface and coupling means pivotally mounted within the angle formed between the horizontal and vertical members and arranged to receive a scaffold support member.

In one embodiment of the invention, a tubular member is pivoted within the right angle formed between the horizontal and vertical members and a pair of bracing struts extend between the extremities of the horizontal and vertical members opposite the said angle, the pivoted tubular member being arranged to receive a tubular scaffold pole arranged to pass between said pair of bracing struts.

In a further embodiment of the invention, the end of the horizontal member remote from the said right angle, is provided with tubular clamping means to enable a tubular support to be located therein, the support projecting above the level of the horizontal member to form a support for a horizontal guard rail and/or the tubular support extending below the level of the horizontal member to ground level to serve as a stabilising support for the bracket.

BRIEF DESCRIPTION OF THE DRAWINGS

The invention will not be described by way of example only with particular reference to the accompanying drawings wherein.

DESCRIPTION OF THE PREFERRED EMBODIMENTS

Figure 1:
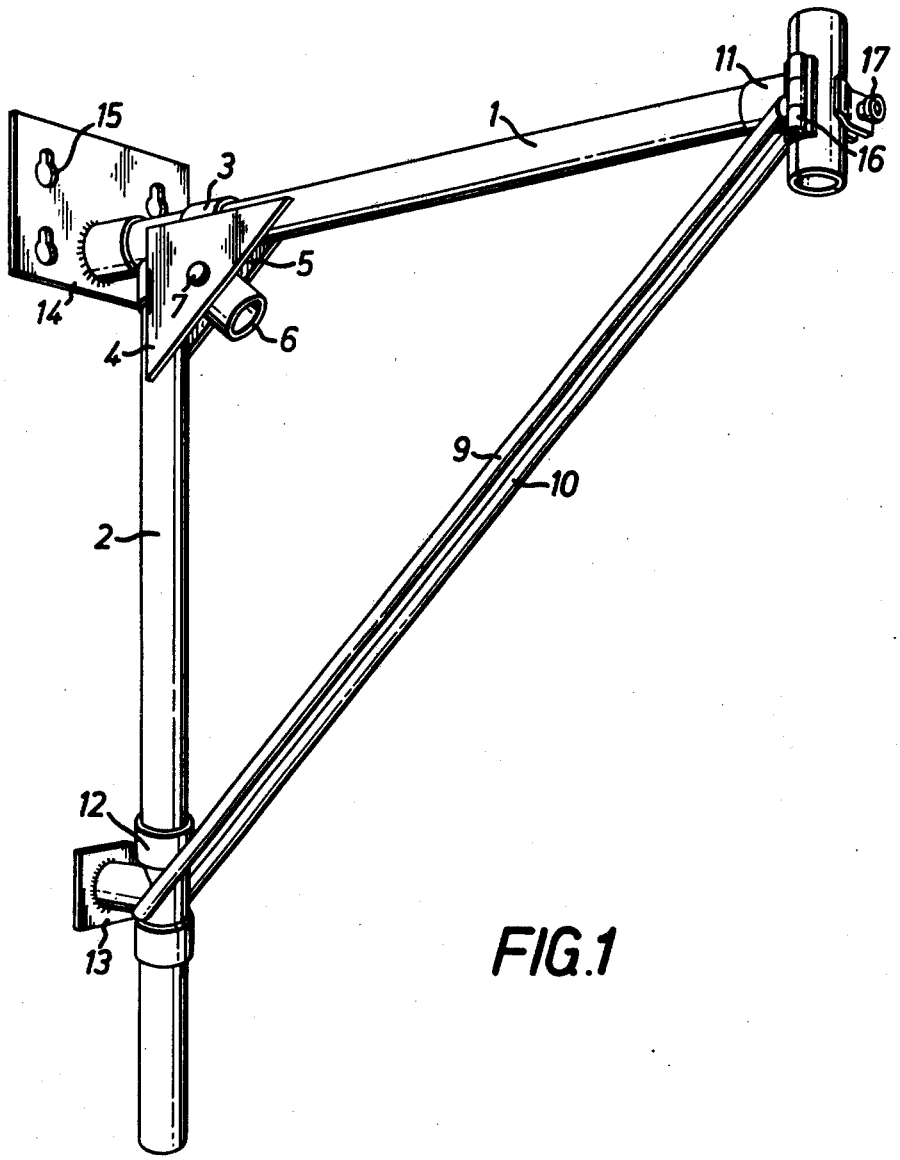
FIG. 1 is a perspective view of the scaffolding bracket of the present invention.

Referring to FIG. 1, the scaffolding bracket comprises a horizontal tubular section 1 connected to a vertical tubular section 2 by means of a tubular T-piece 3, the horizontal section 1 being arranged to support scaffolding boards or lightweight staging (not shown), and the vertical section 2 being arranged to lie closely adjacent a vertical wall surface. A pair of angle plates 4, 5, are welded or otherwise secured to the horizontal and vertical sections, as shown at the angle formed between the two sections. A tubular socket 6, closed at the end adjacent the angle, is pivotally mounted between the two angle plates 4, 5, by pin 7 such as to receive a tubular scaffold pole 8 (see FIG. 3) for the adaption of the bracket to a pole and bracket scaffold. The tubular scaffold pole 8 extends from the socket 6 between a pair of bracing struts 9, 10, welded or otherwise secured to a pair of tubular T-pieces 11, 12, located on the respective ends of the horizontal and vertical sections 1, 2, remote from the angle included therebetween.

Figure 4:
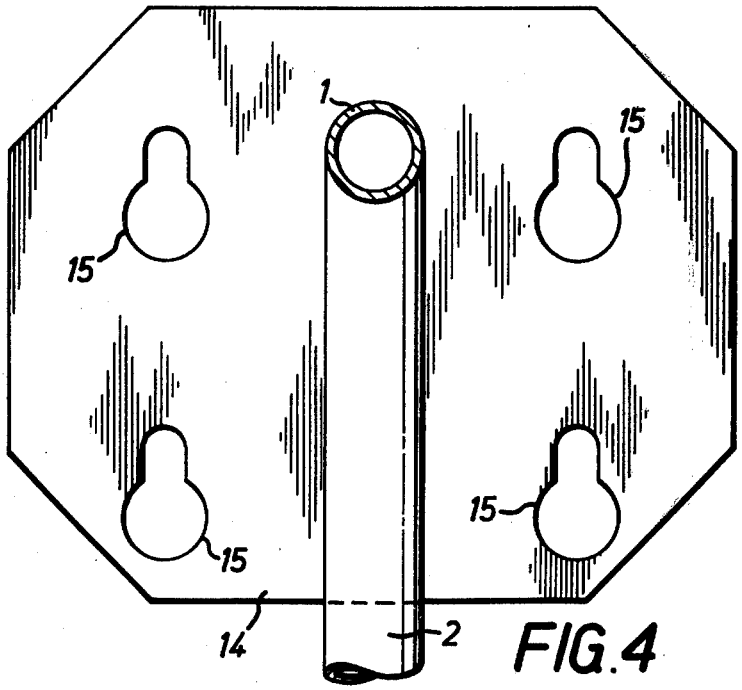
FIG. 4 is a side elevation of the bracket with support struts.

A flat support plate 13 is welded to T-piece 12 and a fixing plate 14 (FIGS. 1 and 4) is welded to T-piece 3 and provided with a plurality of keyhole slots 15 to allow the bracket to be secured to a surface such as a mansonry wall, or a timber, metal or other structure using standard bolts (not shown), or any other form of securing means. The fixing plate may be secured to the bracket, as shown, or may be formed integrally therewith, or formed separately therefrom and, in the latter case, the bracket is suspended from supporting means provided on the fixing plate which is arranged to be secured to the surface or structure.

It will be appreciated that the bolts may be retained in the masonry as a permanent fixture, thus facilitating the erection and removal of the brackets, as and when required; it merely being necessary to hook the slotted plate over the bolts in order to firmly retain the bracket in position on the vertical wall surface.

Figure 2:
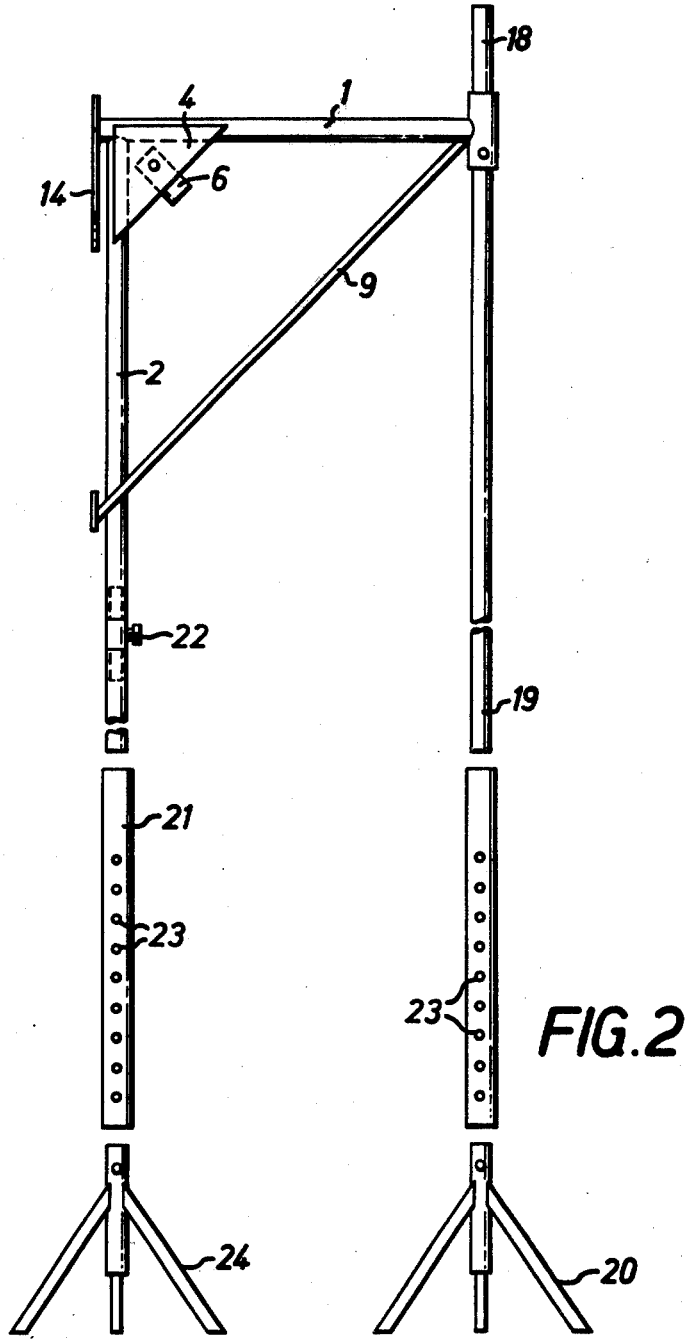
FIG. 2 is a schematic side elevation of a scaffold assembly employing the bracket of the present invention.

T-piece 11 is split longitudinally to form two halves 26 and 28 hinged together by hinge means 16 and the two halves 26 and 28 secured together by locking member 17. The clamping arrangement allows a scaffold pole to be located within the split T-piece 11, the pole projecting above the level of the horizontal section 1 as shown at 18 in FIG. 2 to form a support for a horizontal guard rail and/or extending below the level of the horizontal section 1 to ground level to serve as a stabilising support for the bracket and scaffolding supported thereby. The stabilising support is shown at 19 in FIG. 2 and may be provided with a standard scaffold tube tripod 20 or provided with a wheel to facilitate movement. A further scaffold support pole 21 may be coupled to the vertical section 2 of the bracket by a standard tubular scaffold coupler 22, the pole 21 being provided with a series of holes 23 for adjustment of the height of the pole, and provided with a tripod 24 or wheel to facilitate movement thereof.

Figure 3:
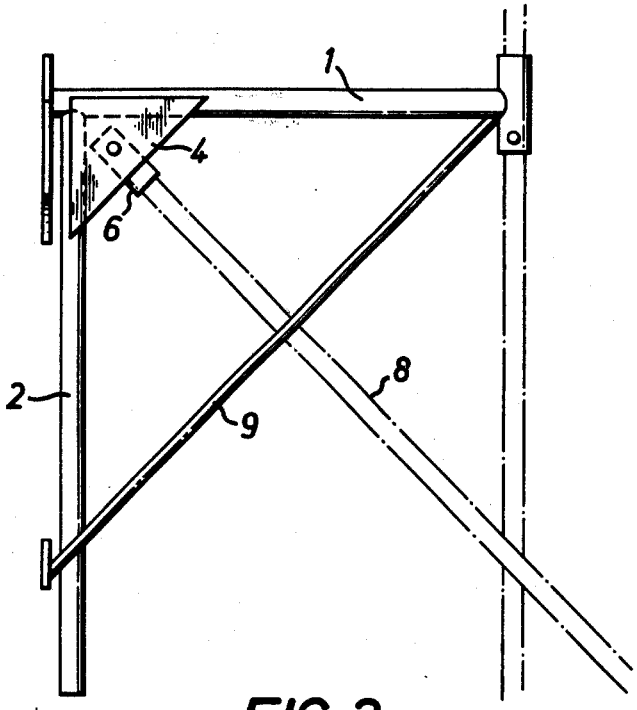
FIG. 3 is a plan view of the back securing plate of the scaffolding bracket.
Figure 6:
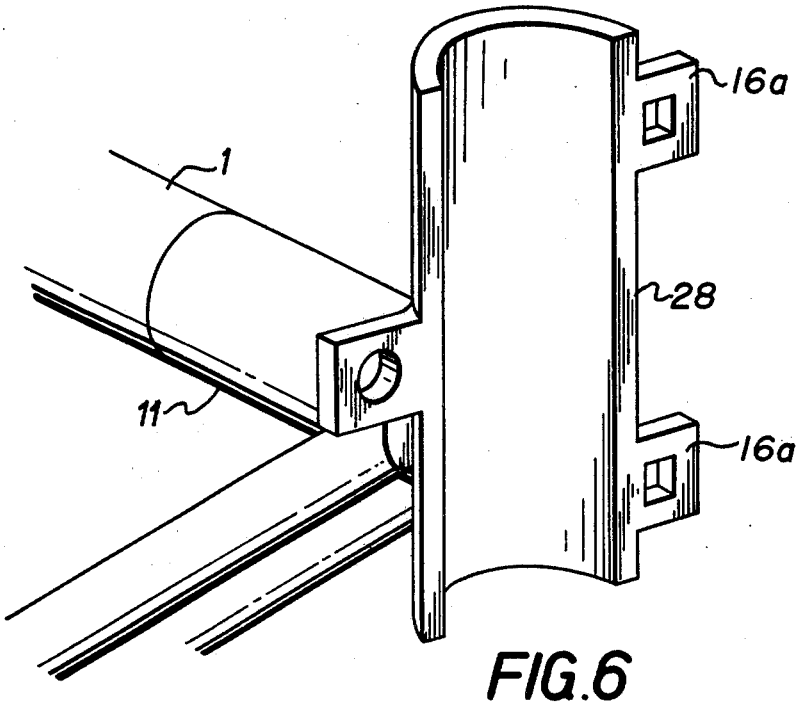
FIGS. 5 and 6 show alternative constructions of clamping means for the bracket of the present invention.
Figure 5:
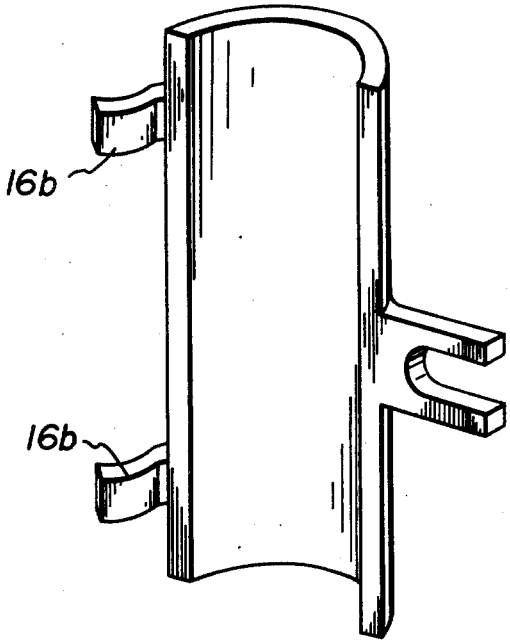
Figure 7:
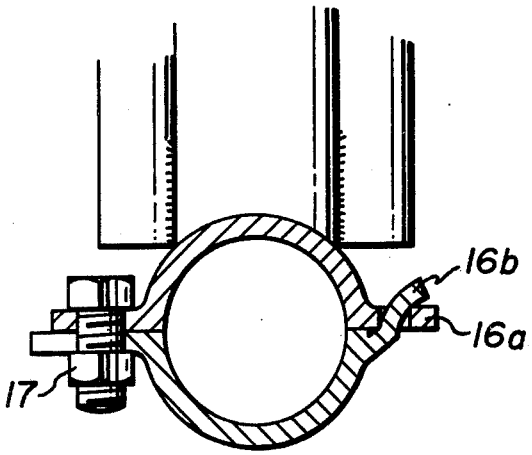
Figure 9:
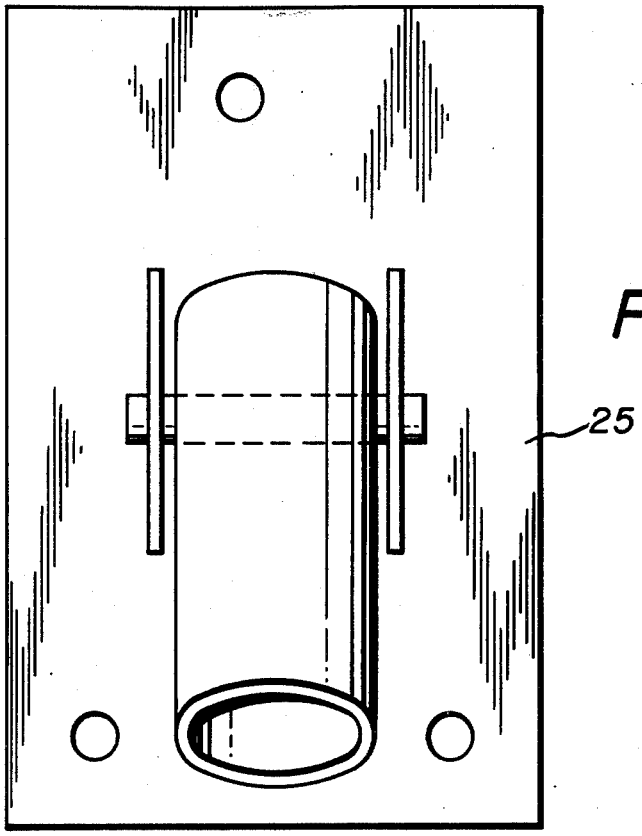
FIGS. 8 and 9 are side elevation and plan views respectively of a swivel shoe plate for the scaffolding bracket of the present invention.
Figure 8:
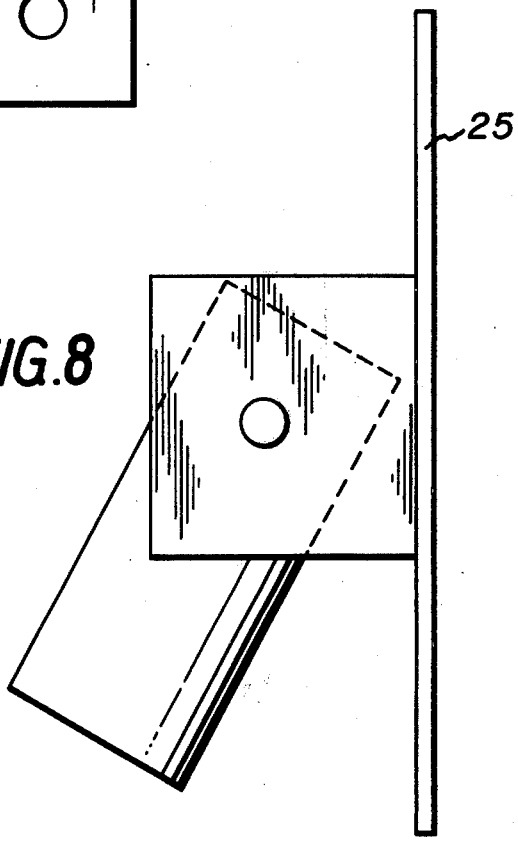

Alternative forms of clamping means are shown in FIGS. 5, 6, where integral lugs **16*a*, 16*b* are provided on the tubular members 26, 28** for retaining support poles in clamping engagement therewith.

Where a pole and bracket type scaffold is used, the swivel shoe plate 25 of FIGS. 8 and 9 may be provided on the extremity of the pole 8 of FIG. 3.

It will be seen that by using a plurality of brackets, scaffolding can be erected quickly and easily using standard scaffold tubes, allowing platforms to be mounted on the scaffolding to enable an operation to be performed on a vertical surface at any required height. The cantilever support provides a rigid, stable and safe construction and the bracket assemblies are far more economical than existing scaffolding assemblies.

What is claimed is:

1. A scaffolding bracket, for use adjacent a vertical surface and which is constructed to receive a scaffolding support member, comprising:

a horizontal member adapted to support scaffolding boards or the like;

a vertical member connected to said horizontal member and arranged to be located adjacent the vertical surface;

mounting means comprising a flat plate connected to said horizontal member and having apertures therein, spaced apart from said vertical member, for securing the scaffolding bracket to the vertical surface;

coupling means pivotally mounted within the angle formed between said horizontal member and said vertical member and being constructed to receive the scaffolding support member;

a pair of bracing struts extend between the extremities of said horizontal member and said vertical member, opposite and remote from the angle which they form;

said coupling means, which is adapted to receive the scaffolding support member, positioned so the scaffolding support member passes between the pair of bracing struts;

a vertical support member;

clamping means located near the end of said horizontal member remote from the angle formed from the vertical member for clamping said vertical support member;

said vertical support member arranged to project above the level of the horizontal member to form a support for a horizontal guard rail;

said clamping means is of a split tubular construction having two halves which are hinged together; and, retaining means for retaining the two halves in engagement.

2. A scaffolding bracket as claimed in claim 1 comprising:

a pair of T-junction members one connected to an extremity of said horizontal member and the other connected to an extremity of said vertical members;

said pair of bracing struts extending between and secured to said pair of T-junction members; and, said clamping means is formed integral with the T-junction member located at the extremity of said horizontal member.

3. A scaffolding bracket as claimed in claim 2 comprising:

a swivel shoe plate for mounting to the extremity of the scaffolding support member remote from the coupling means.

4. A scaffolding bracket, for use adjacent a vertical surface and which is constructed to receive a scaffolding support member, comprising:

a horizontal member adapted to support scaffolding boards or the like;

a vertical member connected to said horizontal member and arranged to be located adjacent the vertical surface;

mounting means connected to said horizontal member and comprising a flat plate having apertures therein, spaced apart from said vertical member, for securing the scaffolding bracket to the vertical surface;

coupling means pivotally mounted within the angle formed between said horizontal member and said vertical member and being constructed to receive the scaffolding support member;

a vertical support member;

clamping means disposed at the end of said horizontal member remote from the angle formed with said vertical member for clamping said vertical support member; and, said vertical support member arranged to extend below the level of the horizontal member to a ground level to serve as a stabilizing support for the bracket.

5. A scaffolding bracket as claimed in claim 4 wherein:

said clamping means is of a split tubular construction having two halves which are hinged together; and, retaining means for retaining the two halves in engagement.

6. A scaffolding bracket as claimed in claim 5 comprising:

a T-junction member for joining said horizontal member and said vertical member;

said horizontal member and said vertical member are of a tubular construction; and, angle means secured to said horizontal member and said vertical member near where they intersect to provide pivotal mounting for said coupling means.

7. A scaffolding bracket comprising:

a horizontal member intended to support scaffolding boards or the like;

a vertical member connected to the horizontal member and arranged to be located adjacent a vertical surface;

a flat bracket having a fixing plate formed integrally therewith and being connected to said horizontal member, spaced apart from said vertical member, having apertures therein;

securing means received by the aperture in said fixing plate to allow said fixing plate and the associated brackets to be screwed to the vertical surface; and, coupling means pivotally mounted within the angle formed between said horizontal member and said vertical member being arranged to receive a scaffolding support member.

8. A scaffolding bracket as claimed in claim 7 wherein:

a pair of bracing struts extend between the extremities of said horizontal member and said vertical member remote from their angle of connection; and, said pivotal coupling means being tubular and arranged to receive said scaffolding support member which is also tubular and positioned to pass between said pair of bracing struts.

9. A scaffolding bracket as claimed in claim 8 wherein:

the end of said horizontal member remote from said vertical member is provided with tubular clamping means to enable a tubular vertical support member to be located therein; and, said tubular support member being arranged to project above the level of said horizontal member to form a support for a horizontal guard rail and said vertical support member being arranged to extend below the level of said horizontal member to ground level to serve as a stabilizing support for the bracket.

10. A scaffolding bracket as claimed in claim 9 wherein:

said clamping means is of a split tubular construction, the two halves of said clamping means being hinged together; and, retaining means for retaining the two halves in engagement.

11. A scaffolding bracket as claimed in claim 7 wherein said securing means for securing the bracket to the vertical surface comprises:

a fixed plate provided with a plurality of key hole slots to allow the bracket to be suspended from bolts located in the vertical surface.

12. A scaffolding bracket as claimed in claim 7 wherein:

said horizontal member and said vertical member are of a tubular construction connected by a T-junction member; and, triangular plates secured to said horizontal member and said vertical member at their point of connection to provide a pivotal mounting for said coupling means.

13. A scaffolding bracket as claimed in claim 12 wherein the extremities of said horizontal member and said vertical member are each provided with a T-junction member, said pair of bracing struts being secured to the T-junction members located at the extremities of said horizontal member and said vertical member and the T-junction member at the extremity of said horizontal member constructed to form a clamp.

* * * * *

UNITED STATES PATENT AND TRADEMARK OFFICE

CERTIFICATE OF CORRECTION

PATENT NO. : 4,179,090

DATED : December 18, 1979

INVENTOR(S) : ALFRED S. WILLIAMS et al.

It is certified that error appears in the above-identified patent and that said Letters Patent are hereby corrected as shown below:

Column 1, line 44, "not" should be --now--.

Signed and Sealed this

*Fifteenth* Day of *April 1980*

[SEAL]

*Attest:*

SIDNEY A. DIAMOND

*Attesting Officer*

*Commissioner of Patents and Trademarks*